US005756929A

United States Patent [19]

Lundstrom et al.

[11] Patent Number: 5,756,929

[45] Date of Patent: May 26, 1998

[54] NONAZIDE GAS GENERATING COMPOSITIONS

[75] Inventors: Norman H. Lundstrom, Tacoma, Wash.; Paresh S. Khandhadia, Troy, Mich.

[73] Assignee: Automotive Systems Laboratory Inc., Farmington Hills, Mich.

[21] Appl. No.: 601,532

[22] Filed: Feb. 14, 1996

[51] Int. Cl.[6] ..... C06B 47/10; C06B 31/02; C06B 29/02

[52] U.S. Cl. ..... 149/22; 149/36; 149/45; 149/61; 149/75; 149/77

[58] Field of Search ..... 149/22, 36, 45, 149/61, 75, 77

[56] References Cited

U.S. PATENT DOCUMENTS

| | | | |
|---|---|---|---|
| 3,739,574 | 6/1973 | Godfrey | 60/39.03 |
| 5,460,668 | 10/1995 | Lyon | 149/36 |
| 5,482,579 | 1/1996 | Ochi et al. | 149/83 |
| 5,516,377 | 5/1996 | Highsmith et al. | 149/18 |
| 5,629,494 | 5/1997 | Barnes et al. | 149/36 |
| 5,641,938 | 6/1997 | Holland et al. | 149/48 |

*Primary Examiner*—Peter A. Nelson
*Attorney, Agent, or Firm*—Lyon, P.C.

[57] ABSTRACT

Multicomponent pyrotechnic gas generating compositions are provided which comprise a single or multiple nonazide fuel. The single and multiple fuels are selected from guanidine, azole, and other high nitrogen aliphatic, aromatic, and/or heterocyclic compounds. The fuels are blended with single and multiple oxidizers. Other materials are added to the compositions for processing, aiding ignition, enhancing ballistics, reducing particulates, and scavenging undesirable gaseous decomposition products. A significant amount of nontoxic gas is formed at acceptable flame temperatures when these compositions are combusted, which allow their use in automotive air bag safety systems.

11 Claims, No Drawings

NONAZIDE GAS GENERATING COMPOSITIONS

BACKGROUND OF THE INVENTION

The present invention relates to relatively nontoxic gas generating compositions which on combustion rapidly generate gases that are useful for inflating occupant safety restraints in motor vehicles, commonly referred to as automotive air bags, and more particularly to nonazide gas generants that produce combustion products having not only acceptable toxicity levels, but also higher gas volume to solid particulates at comparable flame temperatures than heretofore obtained with commercially available nonazide compositions.

One of the disadvantages of nonazide gas generant compositions is the amount and physical nature of the solid residues formed during combustion. The solids produced as a result of combustion must be filtered and otherwise kept away from contact with the occupants of the vehicle. It is therefore highly desirable to develop compositions that produce a minimum of solid particulates while still providing adequate quantities of a nontoxic gas to inflate the safety device at a high rate.

In addition to the fuel constituent, pyrotechnic compositions employed in inflating occupant safety restraints contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable klinker like particulates. Other optional additives, such as burning rate enhancers or ballistic modifiers and ignition aids, which are used to control the ignitability and combustion properties of the gas generant composition have also been developed.

Other advantages and disadvantages of prior art nonazide gas generant compositions in comparison with other gas generants containing azides, have been extensively described in the patent literature such as U.S. Pat. Nos. 4,370,181; 4,909,549; 4,948,439; 5,084,118; 5,139,588 and 5,035,757, the discussions of which are hereby incorporated by reference.

The objects of the present invention are to provide nonazide gas generant compositions for inflating automotive air bag safety restraints which provide higher volumes of nontoxic gas with correspondingly lower concentrations of solid decomposition products, than have been possible with prior art nonazide gas generant compositions, and still maintain reduced toxic gas formation and filterable slag formation.

SUMMARY OF THE INVENTION

The objects of the present invention are accomplished by employing certain derivatives and compounds of guanidine and other high nitrogen-containing compounds, alone or in combination with other high nitrogen nonazides as fuels in gas generant compositions.

More specifically, the present invention comprises the use of one or more high nitrogen nonazides selected from the group consisting of nitroguanidine, nitroaminoguanidine, guanidine nitrate, guanidine perchlorate, guanidine picrate, cyanuric hydrazide, and diammonium bitetrazole, alone or in combination with other high nitrogen nonazides, such as tetrazoles, bitetrazoles, triazines, and triazoles. From a practical standpoint the compositions of the present invention also include some of the additives heretofore used with nonazide gas generant compositions such as oxidizers, gas conversion catalysts, ballistic modifiers, slag formers, ignition aids and compounding aids.

The gas generant compositions of this invention are prepared by the methods heretofore employed for prior art compositions and generally, but not exclusively, involve the dry blending and compaction of comminuted ingredients selected for combination. However, certain gas generant compositions of this invention are prepared when desired using a novel process involving incorporation of wetted aqueous or nonaqueous high nitrogen nonazide constituents during the preparation and manufacturing stages. This allows the use of materials which are classified as flammable solids rather than explosives by the U.S. Department of Transportation during the more hazardous processing stages of manufacture.

DETAILED DESCRIPTION OF THE PREFERRED EMBODIMENTS

In accordance with the present invention the preferred high nitrogen nonazides employed as primary fuels in gas generant compositions for automotive air bag safety restraint systems include in particular guanidine compounds, either separately or in combination, selected from the group consisting of guanidine nitrate, aminoguanidine nitrate, diaminoguanidine nitrate, triaminoguanidine nitrate (wetted or unwetted), guanidine perchlorate (wetted or unwetted), triaminoguanidine perchlorate (wetted or unwetted), guanidine picrate, triaminoguanidine picrate, nitroguanidine (wetted or unwetted), and nitroaminoguanidine (wetted or unwetted). Other preferred high nitrogen nonazides employed as fuels in the gas generant compositions of this invention, either separately or in combination with the above described guanidine compounds, include 2,4,6-trihydrazino-s-triazine (cyanuric hydrazide); 2,4,6-triamino-s-triazine (melamine); and diammonium 5,5'-bitetrazole.

The foregoing preferred primary high nitrogen nonazide fuels can be suitably combined with other known secondary high nitrogen nonazide fuels without sacrificing the benefits resulting from their use. The secondary high nitrogen nonazide fuels which can be combined with the preferred primary high nitrogen nonazide guanidine, triazine, and tetrazole fuels specifically discussed above, include other guanidine compounds such as the metal salts of nitroaminoguanidine, metal salts of nitroguanidine, nitroguanidine nitrate, nitroguanidine perchlorate, tetrazoles such as 1H-tetrazole, 5-aminotetrazole, 5-nitrotetrazole, 5-nitroaminotetrazole, 5,5'-bitetrazole, diguanidinium-5,5'-azotetrazolate, triazoles such as nitroaminotriazole, 3-nitro-1,2,4-triazole-5-one, triazines such as melamine nitrate; and metallic and nonmetallic salts of the foregoing tetrazoles, triazoles, and triazines. The secondary high nitrogen nonazide fuels of the present invention are employed in a concentration of at least 10% by weight of the total multiple fuel composition and preferably in the range of 25 to 75% by weight of the total multiple fuel composition.

The preferred multiple fuel compositions of the present invention permit greater variability in the design of fuels useful in gas generants for automobile air bag safety restraint systems. Thus, it was discovered that the high gas volume/low combustion solids ratios of the guanidine compounds can be combined with other fuels having advantageous properties, such as lower ignition threshold temperatures, easier ignitability and improved burning rate tailoring capability without sacrificing the desirable properties of the individual components to provide synergistically improved superior fuels. Practical gas generant compositions, involve in addition to the fuel, various other components to achieve specific improvements in the performance of the nonazide fuels. When used in combination with other materials the preferred primary or primary/secondary nonazide singular or multiple fuel of the present invention, taken as a whole, should be used in a concentration of at least 15% by weight of the total gas generant composition.

The foregoing guanidines, alone or in combination with other known high nitrogen nonazides, are generally employed in combination with an oxidizer, which is designed to supply most if not all of the oxygen required for combustion. Suitable oxidizers are known in the art and generally comprise inorganic nitrites, nitrates, chlorites, chlorates, perchlorates, oxides, peroxides, persulfates, chromates, and perchromates. Preferred oxidizers are alkali metal and alkaline earth metal nitrates, chlorates, perchlorates such as strontium nitrate, potassium nitrate, sodium nitrate, barium nitrate, potassium chlorate, potassium perchlorate and mixtures thereof. The oxidizer is generally employed in a concentration thereof. The oxidizer is generally employed in a concentration of about 10 to 85% by weight of the total gas generant composition and preferably in a concentration of 25 to 75% by weight of the total gas generant composition.

The combustion of the fuels of the present invention can be controlled by the addition of ballistic modifiers which influence the temperature sensitivity and rate at which the propellant burns. Such ballistic modifiers were primarily developed for solid rocket propellants but also have been found useful in gas generants for inflatable devices. Ballistic modifiers useful in the compositions of the present invention include cyanoguanidine; and inorganic and organic salts of cyanoguanidine including the alkali, alkaline earth, transition metal, ammonium, guanidine, and triaminoguanidine salts; and mixtures thereof. It has been discovered that mixtures of cyanoguanidine and cyanoguanidine salts are also very useful as ballistic modifiers for the gas generant compositions of this invention. Inorganic ballistic modifiers which can be suitably employed include oxides and halides of Group 4 to 12 of the Periodic table of Elements (as developed by IUPAC and published by CRC Press, 1989); sulfur, and metal sulfides; transition metal chromium salts; and alkali metal and alkaline earth metal borohydrides. Guanidine borohydrides and triaminoguanidine borohydrides have also been used as ballistic modifiers. Organometallic ballistic modifiers include metallocenes, ferrocenes and metal acetyl acetonates. Other preferred ballistic modifiers include nitroguanidine, guanidine chromate, guanidine dichromate, guanidine trichromate, and guanidine perchromate. The ballistic modifiers are employed in concentrations varying from about 0.01 to 25% by weight of the total gas generant composition.

In order to reduce the formation of toxic carbon monoxide and nitrogen oxides it may be desirable to include in the compositions of the present invention a catalyst which aids in the conversion of carbon monoxide and nitrogen oxides formed in the combustion to carbon dioxide and nitrogen. Compounds which are useful as catalysts include in particular alkali metal, alkaline earth metal and transition metal salts of tetrazole, bitetrazole, and triazole. Transition metal oxides themselves have also found utility as catalysts for the described gas conversions. The catalysts are normally employed in concentrations of 0.1 to 10% by weight of the total gas generant composition.

Filterable slag formation can be enhanced by the addition of a slag former. Suitable slag formers include lime, borosilicates, vycor glasses, bentonite clay, silica, alumina, silicates, aluminates, transition metal oxides and mixtures thereof.

Another additive found to aid in the temperature of ignition and resulting combustion of the fuel used in inflatable safety devices is an ignition aid. Ignition aids include finely divided elemental sulfur, boron, carbon, magnesium, aluminum, and Group 4 transition metal, transition metal oxides, hydrides and sulfides, the hydrazine salt of 3-nitro-1,2,4-triazole-5-one and mixtures thereof. Preferred ignition aids include elemental sulfur, transition metal oxides, magnesium and hafnium, titanium hydride, the hydrazine salt of 3-nitro-1,2,4-triazole-5-one and mixtures thereof. The ignition aids are normally employed in concentrations of 0.1 to 15% by weight of the total fuel composition.

As indicated above the fuel compositions of the present invention are prepared by physically blending the desired components, such as by ball milling. It may be desirable to add compounding agents to facilitate the compounding and obtain homogeneous mixtures. Suitable processing or compounding aids include molybdenum disulfide, graphite, boron nitride, alkali metal, alkaline earth and transition metal stearates, polyethylene glycols, polyacetals, polyvinyl acetate, fluoropolymer waxes commercially available under the trade name "Teflon" of "Viton" and silicone waxes. The compounding aids are normally employed in concentrations of about 0.1 to 15% by weight of the total gas generant composition.

The manner and order in which the components of the fuel composition of the present invention are combined and compounded is not critical so long as a uniform mixture is obtained and the compounding is carried out under conditions which do not cause decomposition of the components employed. For example, the materials may be wet blended, or dry blended and attrited in a ball mill or Red Devil type paint shaker and then pelletized by compression molding. The materials may also be ground separately or together in a fluid energy mill, sweco vibroenergy mill or bantam micropulverizer and then blended or further blended in a v-blender prior to compaction. However, a significant discovery has been made involving the use of wetted aqueous or nonaqueous nitroguanidine rather than the dry material which allows processing to be carried on during the manufacturing stage with nitroguanidine classified as a Department of Transportation classified 4.1 flammable solid.

The various components described hereinabove for use with the novel fuels of the present invention have been used heretofore in other nonazide fuel compositions. References involving nonazide fuel compositions describing various additives useful in the present invention include U.S. Pat. Nos. 5,035,757; 5,084,118; 5,139,588; 4,948,439; 4,909,549; and 4,370,181, the teachings of which are hereby incorporated by reference. As taught in that art and as will be apparent to those skilled in the art it is possible to combine the functions of two or more additives into a single composition. Thus, alkaline earth metal salts of tetrazoles, bitetrazoles and triazoles not only function as fuel components but can also be used as slag formers. It has been discovered that strontium nitrate acts not only as an oxidizer and a slag former, but also is effective as a ballistic modifier ignition aid densifier and processing aid.

The process of the invention can utilize conventional gas generator mechanisms of the prior art. These are referred to in U.S. Pat. No. 4,369,079, incorporated herein by reference.

Generally, the methods of the prior art involve the use of a hermetically sealed metallic cartridge containing fuel, oxidizer, slag former, initiator and other selected additives. Upon initiation of combustion by the firing of a squib, the sealing mechanism ruptures. This allows gas to flow out of the combustion chamber through several orifices and into an aspirating venturi through which outside air is drawn into the gas formed by combustion so that the gas utilized to inflate the air bag is a mixture of the gas generated by the combustion and outside air.

The present invention is further illustrated by the following representative examples, wherein the components are quantified in weight percent of the total composition unless otherwise stated. Thus, the quantities of the fuels and oxidizers illustrated are by weight percentages of the total gas generant composition and the gaseous exhaust components are stated as weight percentages of the total gaseous exhaust either in the combustion chamber or in the exhaust from the combustion chamber. The analysis is based on the Thermochemical Propellant Evaluation Program developed by the NASA Lewis Research Center at a chamber pressure of 1000 psi and exhausting at atmospheric pressure.

EXAMPLES 1–9

In Examples 1 to 9 the compositions of the present invention are compared to the prior art compositions based on 5-aminotetrazole (Example 1, Table 1) as the sole nonazide fuel. The components of the compositions of the examples are set forth in the attached Tables 1 and 2. The oxidizer employed is strontium nitrate. The Tables further show the flame temperature in degrees Kelvin, the quantity and composition of the exhaust gases generated upon combustion and the quantity of gas in moles generated from 100 g of the fuel composition.

TABLE 1

| EXAMPLES | 1 | 2 | 3 | 4 | 5 |
|---|---|---|---|---|---|
| 5-aminotetrazole | 28.60 | 16.19 | 11.29 | 14.30 | 9.53 |
| Guanidine nitrate | — | 23.24 | 32.40 | 29.26 | 39.00 |
| Nitroguanidine | — | — | — | — | — |
| Nitroaminoguanidine | — | — | — | — | — |
| Strontium nitrate | 71.40 | 60.57 | 56.31 | 56.44 | 51.47 |
| Stoichiometric system | yes | yes | yes | yes | no |
| Flame temp., Chmbr, °K. | 2089 | 2124 | 2136 | 2208 | 2248 |
| $NO_2$, Chmbr/Exh, % | .008/0 | .005/0 | 004/0 | .004/0 | .003/0 |
| CO, Chmbr/Exh, % | .014/0 | .025/0 | .028/0 | .165/0 | .215/0 |
| Nitrogen, Exh, % | 50.73 | 45.25 | 43.42 | 45.66 | 43.97 |
| Oxygen, Exh, % | 12.55 | 8.57 | 7.24 | 8.45 | 7.08 |
| $CO_2$, Exh, % | 22.75 | 23.87 | 24.24 | 24.61 | 25.23 |
| Water Vapor, Exh, % | 13.97 | 22.32 | 25.10 | 23.24 | 26.33 |
| Gas Mass Fraction, Exh, % | 65.04 | 70.34 | 71.47 | 72.37 | 74.81 |
| Moles of Gas/100g, Exh | 2.27 | 2.57 | 2.73 | 2.68 | 2.81 |

TABLE 2

| EXAMPLES | 6 | 7 | 8 | 9 |
|---|---|---|---|---|
| 5-aminotetrazole | 16.47 | 11.56 | 14.30 | 9.53 |
| Guanidine nitrate | 11.82 | 16.60 | — | — |
| Nitroguanidine | 10.08 | 14.15 | — | — |
| Nitroaminoguanidine | — | — | 21.45 | 28.60 |
| Strontium nitrate | 61.63 | 57.69 | 64.25 | 61.87 |
| Stoichiometric system | yes | yes | yes | yes |
| Flame temp., Chmbr, °K. | 2193 | 2227 | 2236 | 2287 |
| $NO_2$, Chmbr/Exh, % | .005/0 | .006/0 | .008/0 | .007/0 |
| CO, Chmbr/Exh, % | .052/0 | .064/0 | .067/0 | .085/0 |
| Nitrogen, Exh, % | 46.32 | 44.84 | 48.12 | 47.25 |

TABLE 2-continued

| EXAMPLES | 6 | 7 | 8 | 9 |
|---|---|---|---|---|
| Oxygen, Exh, % | 8.53 | 7.19 | 11.25 | 10.28 |
| $CO_2$, Exh, % | 24.54 | 25.13 | 24.08 | 24.52 |
| Water Vapor, Exh, % | 20.46 | 22.62 | 18.25 | 19.67 |
| Gas Mass Fraction, Exh, % | 72.55 | 72.55 | 70.99 | 72.97 |
| Moles of Gas/100g, Exh | 2.66 | 2.66 | 2.47 | 2.53 |

EXAMPLE 10

A uniform mixture of 16.27% nitroaminoguanidine, 36.93% guanidine nitrate and 46.8% of strontium nitrate that was analyzed resulted in the following properties:

| EXAMPLE | 10 |
|---|---|
| Flame temp., Chmbr, °K. | 2374 |
| $NO_2$, Chmbr/Exh, % | .002/0 |
| CO, Chmbr/Exh, % | .167/0 |
| Nitrogen, Exh, % | 42.43 |
| Oxygen, Exh, % | 3.30 |
| $CO_2$, Exh, % | 25.07 |
| Water Vapor, Exh, % | 29.19 |
| Gas Mass Fraction, Exh, % | 77.09 |
| Moles of Gas/100g, Exh | 2.94 |

EXAMPLES 11–13

Mixtures of guanidine nitrate and strontium nitrate in the percentages indicated resulted in the following properties:

| EXAMPLES | 11 | 12 | 13 |
|---|---|---|---|
| Guanidine nitrate | 53.51 | 58.51 | 48.51 |
| Strontium nitrate | 46.49 | 41.49 | 51.49 |
| Flame temp., Chmbr, °K. | 2159 | 2328 | 1952 |
| $NO_2$, Chmbr/Exh, % | .002/0 | 0/0 | .003/0 |
| CO, Chmbr/Exh, % | .035/0 | .315/0 | .004/0 |
| Nitrogen, Exh, % | 39.76 | 40.59 | 38.93 |
| Oxygen, Exh, % | 4.59 | 4.35 | 9.04 |
| $CO_2$, Exh, % | 24.98 | 26.47 | 23.42 |
| Water Vapor, Exh, % | 30.67 | 32.51 | 28.61 |
| Gas Mass Fraction, Exh, % | 74.68 | 79.69 | 74.68 |
| Moles of Gas/100g, Exh | 2.96 | 3.08 | 2.83 |

EXAMPLE 14

A uniform mixture of 42.90% of nitroaminoguanidine and 57.10% of strontium nitrate that was analyzed resulted in the following properties:

| EXAMPLE | 14 |
|---|---|
| Flame temp., Chmbr, °K. | 2386 |
| $NO_2$, Chmbr/Exh, % | .007/0 |
| CO, Chmbr/Exh, % | .12/0 |
| Nitrogen, Exh, % | 45.51 |
| Oxygen, Exh, % | 9.95 |
| $CO_2$, Exh, % | 25.40 |
| Water Vapor, Exh, % | 22.52 |
| Gas Mass Fraction, Exh, % | 76.94 |
| Moles of Gas/100g, Exh | 2.66 |

EXAMPLES 15–16

Mixtures of nitroaminoguanidine, 5-aminotetrazole, potassium nitrate and strontium nitrate in the percentages indicated were analyzed and resulted in the following properties:

| EXAMPLES | 15 | 16 |
|---|---|---|
| Nitroaminoguanidine | 23.02 | 18.02 |
| 5-aminotetrazole | 16.44 | 21.44 |
| Potassium nitrate | 19.54 | 19.54 |
| Strontium nitrate | 41.00 | 41.00 |
| Flame temp., Chmbr, °K. | 2226 | 2321 |
| $NO_2$, Chmbr/Exh, % | .003/0 | .002/0 |
| CO, Chmbr/Exh, % | .041/0 | .097/0 |
| Nitrogen, Exh, % | 51.35 | 52.14 |
| Oxygen, Exh, % | 6.81 | 4.38 |
| $CO_2$, Exh, % | 19.53 | 20.81 |
| Water Vapor, Exh, % | 19.94 | 18.94 |
| Gas Mass Fraction, Exh, % | 68.55 | 69.76 |
| Moles of Gas/100g, Exh | 2.49 | 2.50 |

EXAMPLES 17–18

Uniform mixtures of nitroguanidine, guanidine nitrate and strontium nitrate were prepared in the percentages indicated were analyzed resulting in the following properties:

| EXAMPLES | 17 | 18 |
|---|---|---|
| Nitroguanidine | 23.75 | 18.75 |
| Guanidine nitrate | 27.85 | 32.85 |
| Strontium nitrate | 48.40 | 48.40 |
| Flame temp., Chmbr, °K. | 2296 | 2252 |
| $NO_2$, Chmbr/Exh, % | .002/0 | .002/0 |
| CO, Chmbr/Exh, % | .089/0 | .064/0 |
| Nitrogen, Exh, % | 41.90 | 41.38 |
| Oxygen, Exh, % | 4.51 | 5.14 |
| $CO_2$, Exh, % | 26.32 | 25.91 |
| Water Vapor, Exh, % | 26.94 | 27.57 |
| Gas Mass Fraction, Exh, % | 76.30 | 76.30 |
| Moles of Gas/100g, Exh | 2.85 | 2.87 |

EXAMPLE 19

A uniform mixture comprising 28.90% diammonium bitetrazole and 71.10% strontium nitrate was analyzed and resulted in the following properties:

| EXAMPLE | 19 |
|---|---|
| Flame temp., Chmbr, °K. | 2129 |
| $NO_2$, Chmbr/Exh, % | .005/0 |
| CO, Chmbr/Exh, % | .024/0 |
| Nitrogen, Exh, % | 50.51 |
| Oxygen, Exh, % | 8.27 |
| $CO_2$, Exh, % | 22.67 |
| Water Vapor, Exh, % | 18.56 |
| Gas Mass Fraction, Exh, % | 65.19 |
| Moles of Gas/100g, Exh | 2.35 |

EXAMPLE 20

Table 5-2 (LTS-3):

A mixture of 5-aminotetrazole (5AT), guanidine nitrate, and strontium nitrate was prepared having the following composition in percent by weight: 25.00% 5AT, 25.00% guanidine nitrate, and 50.00% strontium nitrate. These powders were ground separately and dry blended. When ignited at atmospheric pressure with a fuse and a small ignition charge of Dupont 4227 smokeless powder, the composition burned thoroughly leaving a hard, porous klinker like residue which is easily filterable. The pH of an 800 ml aqueous rinse was 11.

EXAMPLE 21

Table 5-2 (LTS-3):

The composition of Example 20 was again ignited at atmospheric pressure, but with more difficulty, with only a fuse, and without the Dupont 4227 ignition charge. Again, the mixture burned and left a hard porous klinker like residue which is easily filterable.

EXAMPLE 22

Table 1-1 or Table 5-1 (LTS-5):

A baseline mixture of 5AT and strontium nitrate was prepared having the following composition in percent by weight: 28.60% 5AT and 71.40% strontium nitrate. These powders were prepared and burned as in Example 20 with a fuse and ignition charge, and burned as in Example 21 with only a fuse and without an ignition charge with essentially identical results. However, the pH of an 800 ml aqueous rinse was 7-8.

EXAMPLE 23

Table 1-1 or Table 5-1 (LTS-5):

The mixture from Example 22 was ignited at atmospheric pressure with a propane torch. The composition burned completely leaving a hard porous klinker like residue.

EXAMPLE 24

Table 5-6 (LTS-11):

A mixture of 5AT, guanidine nitrate, and strontium nitrate was prepared having the following composition in percent by weight: 23.26% 5AT, 16.08% guanidine nitrate, and 60.66% strontium nitrate. These powders were ground separately and dry blended. When ignited at atmospheric pressure with a fuse and a small ignition charge of Dupont 4227 smokeless powder, the mixture burned smoothly and completely and left a hard porous klinker like residue which is readily filterable.

EXAMPLE 25

Table 5-6 (LTS-11):

The same mixture as Example 24, when ignited at atmospheric pressure with only a fuse, and without the Dupont 4227 ignition charge, burned smoothly and thoroughly and left an easily filterable hard porous klinker like residue.

EXAMPLE 26

Table 5-5 (LTS-13):

A mixture of 5AT, guanidine nitrate, and strontium nitrate was prepared having the following composition in percent by weight: 20.60% 5AT, 24.12% guanidine nitrate, and 55.28% strontium nitrate. These powders were ground separately and dry blended. When ignited at atmospheric pressure with a fuse and a small ignition charge of Dupont 4227 smokeless powder, the mixture burned smoothly and completely and left a hard porous klinker like residue which is readily filterable. The pH of an 800 ml aqueous rinse was 11.

EXAMPLE 27

Table 5-5 (LTS-13):

The same mixture as Example 26, when ignited at atmospheric pressure with only a fuse, and without the Dupont 4227 ignition charge, burned smoothly and thoroughly and left an easily filterable hard porous klinker residue.

EXAMPLE 28

Table 5-4 (LTS-12):

A mixture of 5AT, guanidine nitrate, and strontium nitrate was prepared having the following composition in percent by weight: 26.79% 5AT, 12.49% guanidine nitrate, and 60.72% strontium nitrate. The powders were ground separately and dry blended. When ignited at atmospheric pressure with a propane torch, the composition burned completely forming a hard residue which was somewhat porous and readily filterable.

EXAMPLE 29

Table 1-2 or Table 5-3 (LTS-7):

A mixture of 5AT, guanidine nitrate, and strontium nitrate was prepared having the following composition in percent by weight: 16.19% 5AT, 23.24% guanidine nitrate, and 60.57% strontium nitrate. The powders were ground separately and dry blended. When ignited with only a fuse, fuse and Dupont 4227 smokeless powder, or a propane torch, the composition burned to completion leaving a hard porous readily filterable klinker like residue.

EXAMPLE 30

Table 3-4 (LTS-22):

A mixture of nitroguanidine and strontium nitrate was prepared having the following composition in percent by weight: 50.00% nitroguanidine and 50.00% strontium nitrate. These powders were ground separately and dry blended. When ignited at atmospheric pressure with only a fuse, fuse and Dupont 4227 smokeless powder, or a propane torch, the composition burned to completion leaving a hard porous readily filterable klinker like residue. The pH of an 800 ml aqueous rinse was 7-8.

EXAMPLE 31

Table 3-2 (LTS-24):

A mixture of nitroguanidine and strontium nitrate was prepared having the following composition in percent by weight: 40.00% nitroguanidine, 60.00% strontium nitrate. These powders were ground separately and dry blended. When ignited at atmospheric pressure with only a fuse, fuse and Dupont 4227 smokeless powder, or a propane torch, the composition burned to completion leaving a hard porous readily filterable klinker like residue. The pH of a 800 ml aqueous rinse was 7-8. In this example, it will be observed by those skilled in the art that the flame temperature is 131 degrees cooler and the nontoxic gas output is significantly greater than the baseline nonazide 5-aminotetrazole formulation shown in Example 1, Table 1.

EXAMPLE 32

Table 4-2 (LTS-23):

A mixture of nitroguanidine and guanidine nitrate and strontium nitrate was prepared having the following composition in percent by weight: 25.00% nitroguanidine, 25.00% guanidine nitrate, 50.00% strontium nitrate. These powders were ground separately and dry blended. When ignited at atmospheric pressure with only a fuse or a propane torch the ignitability was marginal. When ignited with a combination fuse and Dupont 4227 smokeless powder the ignitability was acceptable, the composition burned to completion leaving a hard porous readily filterable klinker like residue.

EXAMPLE 33

Table 5-7 (LTS-15):

A mixture of 5-aminotetrazole, guanidine nitrate, nitroguanidine and strontium nitrate was prepared having the following composition in percent by weight: 16.47% 5-aminotetrazole, 11.82% guanidine nitrate, 10.08% nitroguanidine, and 61.63% strontium nitrate. These powders were ground separately and dry blended. When ignited at atmospheric pressure with only a fuse, or fuse and Dupont 4227 smokeless powder, the composition burned to completion leaving a hard porous readily filterable klinker like residue. Ignition with only a propane torch was marginal. The pH of a 800 ml aqueous rinse was 7-8.

EXAMPLE 34

Table 5-8 (LTS-16):

A mixture of 5-aminotetrazole, guanidine nitrate, nitroguanidine and strontium nitrate was prepared having the following composition in percent by weight: 11.56% 5-aminotetrazole, 16.60% guanidine nitrate, 14.15% nitroguanidine, and 57.69% strontium nitrate. These powders were ground separately and dry blended. When ignited at atmospheric pressure with only a fuse, or fuse and Dupont 4227 smokeless powder, the composition burned to completion leaving a hard porous readily filterable klinker like residue. Ignition with only a propane torch was marginal. The pH of a 800 ml aqueous rinse was 7-8.

EXAMPLE 35

Table 3-1 (LTS-25):

A mixture of nitroguanidine and strontium nitrate was prepared having the following composition in percent by weight: 35.00% nitroguanidine and 65.00% strontium nitrate. These powders were ground separately and dry blended. When ignited at atmospheric pressure with only a fuse, fuse and Dupont 4227 smokeless powder, or a propane torch, the composition burned to completion leaving a hard porous readily filterable klinker like residue. The pH of an 800 ml aqueous rinse was 7-8. It will be obvious to those skilled in the art that the composition evaluated in this example provides a comparable nontoxic gas output to the baseline 5-aminotetrazole composition, but achieves it at a flame temperature which is 448° lower than the baseline composition.

EXAMPLE 36

(LTS-27):

A mixture of nitroguanidine, 5-aminotetrazole, strontium nitrate, and potassium nitrate was prepared having the following composition in percent by weight: 20.72% nitroguanidine, 16.39% 5-aminotetrazole, 42.23% strontium nitrate, and 20.12% potassium nitrate. These powders were ground separately and dry blended. When ignited at atmospheric pressure with only a fuse or a fuse and Dupont 4227 smokeless powder, the composition burned to completion and appeared to burn faster than a composition using only strontium nitrate as the oxidizer. A hard solid mass resulted.

EXAMPLE 37

(LTS-29):

A mixture of nitroguanidine and barium nitrate was prepared having the following composition in percent by weight: 60.00% barium nitrate and 40.00% nitroguanidine. These powders were ground separately and dry blended. When ignited at atmospheric pressure with a fuse and Dupont 4227 smokeless powder, the composition burned very smoothly in a uniform manner to completion. A hard mass resulted after burning the composition.

EXAMPLE 38.

(LTS-30):

A mixture of guanidine nitrate, 5-aminotetrazole, potassium perchlorate, and strontium nitrate was prepared having the following composition in percent by weight: 19.90% guanidine nitrate, 22.40% 5-aminotetrazole, 14.70% potassium perchlorate, and 43.00% strontium nitrate. These powders were ground separately and dry blended. When ignited at atmospheric pressure with a fuse and Dupont 4227 powder, the composition burned rapidly to completion with an audible roar leaving a hard solid mass on completion of combustion.

EXAMPLE 39

(LTS-31):

A mixture of barium nitrate, sulfur, and nitroguanidine was prepared having the following composition in percent by weight: 51.00% barium nitrate, 15.00% sulfur, and 34.00% nitroguanidine. These powders were ground separately and dry blended. When ignited at atmospheric pressure with a fuse and Dupont 4227 smokeless powder, the composition burned rapidly to completion leaving a hard mass. The composition appeared to burn more rapidly with the incorporation of the sulfur.

EXAMPLE40

(LTS-32):

A mixture of barium nitrate, nitroguanidine, the sodium salt of cyanoguanidine, and cyanoguanidine was prepared having the following composition in percent by weight: 51.00% barium nitrate, 34.00% nitroguanidine, 10.00% sodium salt of cyanoguanidine, and 5.00% cyanoguanidine. These powders were ground separately and dry blended. When ignited at atmospheric pressure with a fuse and Dupont 4227 smokeless powder, the composition burned very rapidly in a uniform manner to completion leaving a hard mass.

EXAMPLE 41

(LTS-33):

A mixture of guanidine nitrate, 5-aminotetrazole, potassium chlorate, and strontium nitrate was prepared having the following composition in percent by weight: 19.90% guanidine nitrate, 22.40% 5-aminotetrazole, 20.00% potassium chlorate, and 37.70% strontium nitrate. These powders were ground separately and dry blended. When ignited at atmospheric pressure with a fuse and Dupont 4227 smokeless powder, the composition burned quickly and erratically.

TABLE 3

| EXAMPLES | LTS-25 1 | LTS-24 2 | 3 | LTS-22 4 | 5 |
|---|---|---|---|---|---|
| Nitroguanidine | 35 | 40 | 45 | 50 | 55 |
| Strontium Nitrate | 65 | 60 | 55 | 50 | 45 |
| Flame temp., Chmbr, °K. | 1641 | 1958 | 2235 | 2467 | 2621 |
| $NO_2$, Chmbr/Exh, % | .007/0 | .007/0 | .006/0 | .003/0 | .001/0 |
| CO, Chmbr/Exh, % | 0/0 | .005/0 | .054/0 | 3.32/0 | 1.58/.001 |
| Gas Mass Fraction, Exh, % | 65.57 | 70.62 | 73.07 | 75.52 | 77.97 |
| Moles of Gas/100 g, Exh | 2.28 | 2.53 | 2.64 | 2.75 | 2.86 |
| pH of aqueos Rinse of combustion products | 7–8 | 7–8 | — | 7–8 | 7–8 |

TABLE 4

| | LTS-23 1 | 2 | 3 | 4 | 5 | 6 | 7 | LTS-26 8 |
|---|---|---|---|---|---|---|---|---|
| Nitroguanidine | 15 | 25 | 35 | 10 | 15 | 20 | 10 | 15 |
| Guanidine nitrate | 35 | 25 | 15 | 30 | 25 | 20 | 25 | 15 |
| Strontium nitrate | 50 | 50 | 50 | 60 | 60 | 60 | 65 | 70 |
| Flame Temperature, °K. | 2156 | 2247 | 2337 | 1641 | 1694 | 1747 | 1475 | 1312 |
| $NO_2$ | .004/0 | .004/0 | .004/0 | .005/0 | .006/0 | .006/0 | .006/0 | .006/0 |
| CO, Chmbr/Exh, 96: | .036/0 | .073/0 | .14/0 | 0/0 | 0/0 | 0/0 | 0/0 | 0/0 |
| Gas Mass Fraction, Exh. % | 75.52 | 75.52 | 75.52 | 67.16 | 67.90 | 68.62 | 62.64 | 59.77 |
| Moles of Gas/100 g | 2.84 | 2.81 | 2.79 | 2.41 | 2.44 | 2.47 | 2.18 | 2.02 |
| Ph of 800 ml rinse | — | 6–7 | — | — | — | — | — | 7–8 |

TABLE 5

AIRBAG PROPELLANT SCIENTIFIC ANALYSIS - LTS/ASL010596-1

| | Baseline LTS-5 1 | LTS-3 2 | LTS-7 3 | LTS-12 4 | LTS-13 5 | LTS-11 6 | LTS-15 7 | LTS-16 8 | LTS-18 9 | LTS-1 10 |
|---|---|---|---|---|---|---|---|---|---|---|
| 5-Aminotetrazole | 28.60 | 25 | 16.19 | 26.79 | 20.60 | 23.26 | 16.47 | 11.56 | 25.00 | 25.00 |
| Guanidine nitrate | — | 25 | 23.24 | 12.49 | 24.12 | 16.08 | 11.82 | 16.60 | 10.00 | 20.00 |
| Nitroguanidine | — | — | — | — | — | — | 10.08 | 14.15 | 10.00 | 5.00 |
| Strontium nitrate | 71.40 | 50 | 60.57 | 60.72 | 55.28 | 60.66 | 61.63 | 57.69 | 55.00 | 50.00 |
| Stoichiometric system | YES | — | YES | — | — | — | YES | YES | — | — |
| Flame Temp., Chmbr, °K. | 2089 | 2430 | 2124 | 2482 | 2472 | 2371 | 2190 | 2225 | 2598 | 2454 |
| $NO_2$, Chmbr/Exh, % | .008/0 | 0/0 | 005/0 | .002/0 | 001/0 | 004/0 | 006/0 | 005/0 | 0/0 | 0/0 |
| CO, Chmbr/Exh, % | .014/0 | 4.83/2.66 | .025/0 | .42/0 | .55/0 | .17/0 | .038/0 | .054/0 | 2.29/1.60 | 6.75/38 |

TABLE 5-continued

AIRBAG PROPELLANT SCIENTIFIC ANALYSIS - LTS/ASL010596-1

| | Baseline LTS-5 1 | LTS-3 2 | LTS-7 3 | LTS-12 4 | LTS-13 5 | LTS-11 6 | LTS-15 7 | LTS-16 8 | LTS-18 9 | LTS-1 10 |
|---|---|---|---|---|---|---|---|---|---|---|
| Nitrogen, Exh, % | 50.73 | 51.21 | 45.25 | 50.98 | 48.46 | 49.16 | 46.64 | 45.14 | 51.78 | 51.74 |
| Oxygen, Exh, % | 12.55 | 0.00 | 8.57 | 2.90 | 13.91 | 4.84 | 8.96 | 7.66 | 0.00 | 0.00 |
| $CO_2$, Exh, % | 22.75 | 23.52 | 23.87 | 26.13 | 26.53 | 25.36 | 24.41 | 25.01 | 25.91 | 23.40 |
| Water Vapor, Exh, % | 13.97 | 21.31 | 22.32 | 19.98 | 23.61 | 20.64 | 19.99 | 22.19 | 20.59 | 20.55 |
| Gas Mass Fraction, Exh, % | 65.04 | 75.52 | 70.34 | 70.27 | 72.93 | 70.30 | 69.82 | 71.75 | 73.07 | 75.52 |
| Moles of Gas/100 g, Exh | 2.27 | 2.93 | 2.57 | 2.54 | 2.69 | 2.55 | 2.52 | 2.62 | 2.70 | 2.93 |
| RESULT OF TESTS AT ATMOSPHERIC PRESSURE (5 GM SAMPLE): | | | | | | | | | | |
| Ignition, fuse | ++ | # | + | | + | + | + | + | ++ | + |
| Ignition, booster | ++ | + | + | | ++ | ++ | ++ | + | ++ | + |
| Ignition, Propane Torch | + | # | # | ++ | | ++ | # | # | # | # |
| Burn to completion | + | + | + | + | + | + | + | + | ++ | ++ |
| Klinker formation | + | + | + | + | + | + | + | + | ++ | ++ |
| pH 800 ml aqueous rinse | 7–8 | 11 | | | 11 | | 7–8 | 7–8 | 9–11 | 12–13 |

++ = very positive
+ = positive
# = neutral

The foregoing examples demonstrates that a significant increase in nontoxic gas output is realized at acceptable and comparable flame temperatures when compared with a very high gas output state of the art baseline composition containing 5-aminotetrazole and strontium nitrate. The substitution of guanidine nitrate for the baseline 5-aminotetrazole fuel component (Examples 11–13) results in a much higher gas mass fraction. This allows a lower weight and volume of propellant to be required in a volume-limited application. In addition because of the decreased concentration of particulates formed during the decomposition fewer solids need to be filtered out of the gas stream. It will also be apparent to those skilled in the art that insignificant levels of toxic gases such as nitrogen oxides and carbon monoxide are formed during the combustion by the preferred compositions without the use of a catalyst as shown by the foregoing examples.

Even when the 5-aminotetrazole fuel of the stoichiometric baseline nonazide composition is only partially substituted with guanidine nitrate (Examples 2, 3, 4 and 5 of Table 1), a significant increase in the gas mass fraction and moles of gas results at comparable flame temperatures. The same result is also accomplished by substituting nitroguanidine alone (Examples 1–5 of Table 3) or in combination with guanidine nitrate for the baseline aminotetrazole component (Examples 17 and 18). Again a significant improvement in gas yield results at slightly higher but acceptable flame temperatures. The flame temperature can also be reduced by substitution of more guanidine nitrate for nitroguanidine with essentially no change in gas fraction or yield. The use of nitroguanidine and/or nitroaminoguanidine is attractive for increasing the overall density of the gas generant composition for use in volume limited applications. In addition, when nitroguanidine is used as the fuel constituent, the flame temperature of the gas generant composition is significantly lower at a comparable molar gas output when compared to the state of the art 5-aminotetrazole based composition. When the aminotetrazole fuel of the baseline composition is partially substituted with nitroguanidine or a combination of nitroguanidine and guanidine nitrate, a significant increase in the moles of gas per 100 g of propellant at comparable flame temperatures results (Examples 6 and 7).

It has also been discovered that when nitroguanidine is incorporated into all of the experimental gas generant compositions used as examples of this invention, that the ignitability of the compositions is greatly improved as well as the burning rate. In addition to a significant increase in gas yield and moles of gas formed, when compared with either prior art azide or nonazide gas generant compositions, the use of combinations of guanidine nitrate and nitroguanidine or nitroaminoguanidine with 5-aminotetrazole as a multiple constituent fuel for the gas generant allows greater precision for tailoring the burning rate, burning rate pressure exponent, ignitability, and the amount and physical form of the slag and klinkers produced on combustion. The use of a multiple ingredient fuel containing constituents with different densities such as guanidine nitrate and/or nitroguanidine and/or nitroaminoguanidine and/or 5-aminotetrazole as described in the examples of this invention further allows a greater capability for tailoring and adjusting the resultant gas generant composition density while maintaining the required reactant stoichiometry, as that exhibited with prior art singular fuels.

The discovery of the foregoing desirable and unique characteristics of nitroguanidine and quanidine nitrate discussed above for use in multiple or singular fuels for the gas generant compositions disclosed in this invention is considered to be a very important finding. Nitroguanidine can therefore be classified as either a fuel constituent or a multipurpose fuel/ballistic modifier/ignition aid, catalyst and densifier for the purposes of this invention.

Example 19 demonstrates that diammonium bitetrazole when evaluated with strontium nitrate as the oxidizer provides a fuel that yields a gas mass fraction at comparable temperature to 5-aminotetrazole.

While the foregoing examples illustrate the use of preferred fuels and oxidizers it is to be understood that the practice of the present invention is not limited to the particular fuels and oxidizers illustrated and similarly does not exclude the inclusion of other additives as described above and as defined by the following claims.

We claim:

1. A gas generant composition useful for inflating an automotive air bag passive restraint system containing as a fuel at least one high nitrogen nonazide constituent selected from the group consisting of guanidine nitrate, aminoguanidine nitrate, nitroguanidine, nitroaminoguanidine, diaminoguanidine nitrate, guanidine perchlorate, and guanidine picrate, wherein:

said fuel further consists of diammonium bitetrazole; and said fuel is employed in a concentration of 5 to 85% by weight of the gas generant composition.

2. A gas generant composition useful for inflating an automotive air bag passive restraint system containing as a fuel at least one high nitrogen nonazide constituent selected from the group consisting of guanidine nitrate, aminoguanidine nitrate, nitroguanidine, nitroaminoguanidine, diaminoguanidine nitrate, guanidine perchlorate, and guanidine picrate, wherein:

said fuel further consists of 2,4,6-trihydrazino-s-triazine; and said fuel is employed in a concentration of 5 to 85% by weight of the gas generant composition.

3. The gas generant composition of claim 2 wherein the fuel is employed in a concentration of 10 to 85% by weight of the gas generant composition.

4. The gas generant of claim 3 wherein the fuel is combined with from 10–85% by weight of the gas generant of an oxidizer.

5. The gas generant composition of claim 4 wherein the oxidizer is an alkali metal, alkaline earth metal, or transition metal nitrate, nitrite, chlorate, chlorite, perchlorate, chromate, oxide, sulphide, or mixtures thereof.

6. The gas generant composition of claim 1 containing finely divided elemental sulfur.

7. The gas generant composition of claim 5 further comprising a ballistic modifier selected from the group consisting of: cyanoguanidine; inorganic and organic salts of cyanoguanidine; oxides and halides of Group 4 to 12 of the IUPAC Periodic Table of Elements; sulfur, and metal sulfides; transition metal chromium salts; alkali metal and alkaline earth metal borohydrides; guanidine and triaminoguanidine borohydrides; organometallic compounds; nitroguanidine, guanidine chromate, guanidine dichromate, guanidine trichromate, and guanidine perchromate; and mixtures thereof;

wherein the ballistic modifier is employed in a concentration of 0.01 to 20% by weight of the gas generant.

8. The gas generant of claim 1 wherein the fuel is combined with from 10–85% by weight of the gas generant of an oxidizer.

9. The gas generant composition of claim 8 wherein the oxidizer is an alkali metal, alkaline earth metal, or transition metal nitrate, nitrite, chlorate, chlorite, perchlorate, chromate, oxide, sulphide, or mixtures thereof.

10. The composition of claim 7 wherein the inorganic and organic salts of cyanoguanidine are selected from the group consisting of alkali, alkaline earth, transition metal, ammonium, guanidine, and triaminoguanidine salts.

11. The composition of claim 7 wherein the organometallic ballistic modifiers are selected from the group consisting of metallocenes, ferrocenes, and metal acetyl acetonates.

* * * * *